United States Patent [19]

Sharp

[11] Patent Number: 4,526,091

[45] Date of Patent: Jul. 2, 1985

[54] ADJUSTABLE ROOF JACK

[75] Inventor: Donald W. Sharp, Phoenix, Ariz.

[73] Assignee: Reynalda Clack, Phoenix, Ariz.

[21] Appl. No.: 637,122

[22] Filed: Aug. 2, 1984

[51] Int. Cl.[3] ..... F24F 13/02; E04B 7/18

[52] U.S. Cl. ..... 98/39.1; 285/44; 285/424

[58] Field of Search ..... 98/39, 43 C; 138/DIG. 8; 285/43, 44, 184, 424; 16/226

[56] References Cited

U.S. PATENT DOCUMENTS 1,370,199 3/1921 Downs ..... 285/43

1,804,954 5/1931 Rutherford ..... 285/424 X 3,742,659 7/1973 Drew ..... 98/61 X

*Primary Examiner*—Harold Joyce

*Attorney, Agent, or Firm*—M. David Shapiro

[57] ABSTRACT

The invention comprises an economical, adjustable roof jack for connecting a roof mounted air handler to an air duct therebelow, wherein a single sheet metal pattern comprises a portion of a lower and upper section of duct and wherein the duct sections are connected, each to the other, by means of a sheet metal bend hinge in the single sheet metal pattern thereby allowing adjustment of the angle between the upper and lower duct sections and providing a water and weather tight seal along the hinge line therebetween.

3 Claims, 4 Drawing Figures

ADJUSTABLE ROOF JACK

FIELD OF THE INVENTION

The invention relates to a one adjustable roof jack comprising ductwork which may be adjusted to fit any of a range of roof slopes and provide an air conduit connection from a horizontal, roof-mounted air handler, such as in an air conditioner, space heater or an evaporative cooler, to an air duct emerging from the roof.

BACKGROUND OF THE INVENTION

Roof jacks are provided to connect the outlet of a roof mounted air handler to an air duct which emerges from the roof. Prior art roof jacks are constructed to match the horizontally oriented opening in the bottom of the air handler to the slope of the roof. Generally, each roof jack must be specially constructed to fit the slope of the roof upon which it is to be used. However, roof jacks for flat roofs and for roof slopes of 4/12 (4 in 12; 4 units of vertical rise for each unit of horizontal run) are generally stocked by suppliers who deal in such devices because these are commonly used roof slopes. Even in those cases, the slope of the roof may be slightly deviant from the design value and a stock roof jack may not fit the angle perfectly. The misfit may cause air leakage from the system or may cause the roof mounted equipment to be mounted at a slight angle from the horizontal which could, in turn, cause problems in operation of the roof mounted equipment.

While suppliers could, and do different roof jacks to accommodate the full range of slopes which are encountered in the building industry, it is expensive to maintain such a large inventory, both in terms of the cost of the stock and the cost of storage space. The problem is even more critical when it is understood that there must be several different sizes (in terms of cross section) of roof jacks to meet the needs of various duct and exhaust outlet sizes which are encountered in roof mounted air handlers.

U.S. Pat. No. 3,742,659, by Drew, "Apparatus for Mounting Equipment on a Roof" (issued July 3, 1973), incorporates, as part of the invention therein described, an adjustable roof jack for a roof mounted air conditioner or the like. It comprises a first section which is attached to the roof and to the ducts emerging from the roof and a second section which connects to the bottom of the roof mounted equipment. The two sections are assembled in one of two orientarions with respect to each other and then the angle between the two sections is adjusted until the upper mounting surface is horizontal. The two sections are then fastened together to provide a solid platform for mounting the equipment and to provide an accurately angled duct between the equipment and the roof. While Drew's invention provides more than an adjustable roof jack, it must be noted that the roof jack portion of his invention, if adapted solely to that use, would use much more sheet metal in its construction than a fixed angle roof jack would use. This is true because Drew's design requires a large overlap in the sheet metal sections which serve as the upper and lower portions of the roof jack. A large part of the overlap is required to prevent water leakage between the sections and to provide a large range of angular adjustment.

SUMMARY OF THE INVENTION

These and other problems with prior art roof jacks are resolved by means of the instant invention. According to the invention, a single piece roof jack is provided which is adjustable in terms of the range of angles which may be matched between the roof and the air handler. The design of the invention requires only a little more sheet metal to construct than a fixed angle roof jack of the same cross section. thus, it is economical to manufacture and a single design may be stocked by a supplier to accommodate a large range of roof slope angles. A bend in a single piece of sheet metal acts as a hinge for angular adjustment purposes. Since that hinge is integral in the bend of the sheet metal, it cannot leak. Because of the hinge design of the invention, less sheet metal is used in fabrication than in prior art two section adjustable roof jacks, as before described.

Therefore, it is an object of the invention to provide an adjustable roof jack wherein an upper and lower section thereof are hinged together by means of a bend in a single piece of sheet metal.

It is another object of the invention to provide an adjustable roof jack with the use of sheet metal minimized.

It is still another object of the invention to provide a hinged adjustable roof jack wherein there can be no water leak in the hinge.

It is yet another object of the invention to provide an adjustable roof jack of economical cost.

It is a further object of the invention to provide a single roof jack which may be stocked to accommodate a large range of roof slopes.

These and other aspects of the invention will be better understood by study of the Detailed Description of the Invention, infra, together with the drawings, in which.

DETAILED DESCRIPTION OF THE INVENTION

Figure 1:
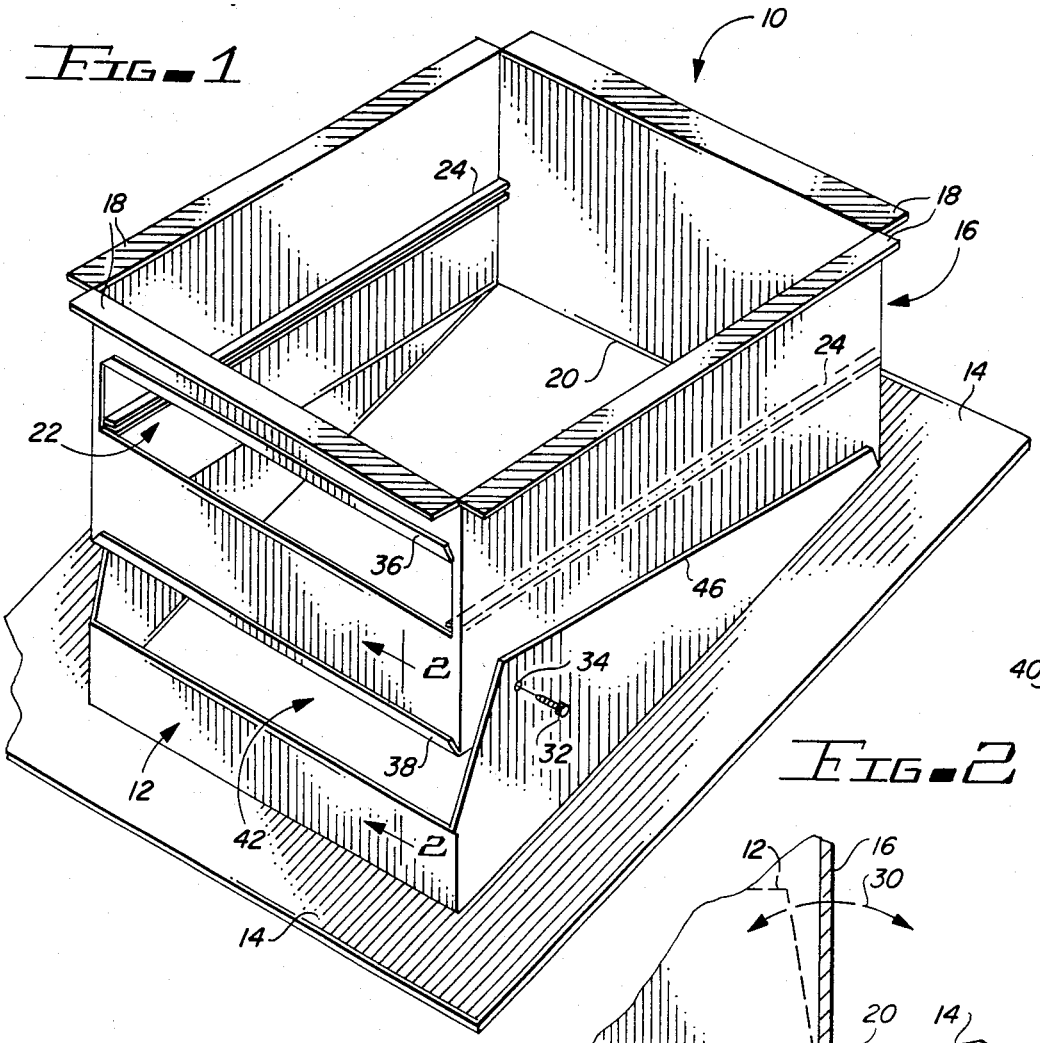
FIG. 1 is a three-quarter view of the roof jack of the invention.

It will be understood that where a reference numeral is used in this description in more than one figure, it is used to identify the same element of the invention in each case.

FIG. 1 illustrates a preferred embodiment of the adjustable roof jack 10 of the invention. Lower section 12 has flange portion 14 which surrounds the lower portion of section 12. Upper section 16 is equipped with upper flange 18. Upper section 16 is joined to lower section 12 by means of a sheet metal bend along edge 20. The bend at edge 20 acts as a waterproof and weatherproof hinge between upper section 16 and lower section 12. The output duct of an air handler (not shown) fits against flange 18 or within the duct orifice formed at the top of upper section 16. Lower section 12 flange 14 is adapted to be fastened to the roof of a building and over the stub of a duct which emerges therefrom (not shown). Flange 14 provides an effective flashing for roof jack 10. It will be understood that upper flange 18 and lower flange 14 serve similar purposes and operate in the same way as similar flanges in prior art devices.

Figure 3:
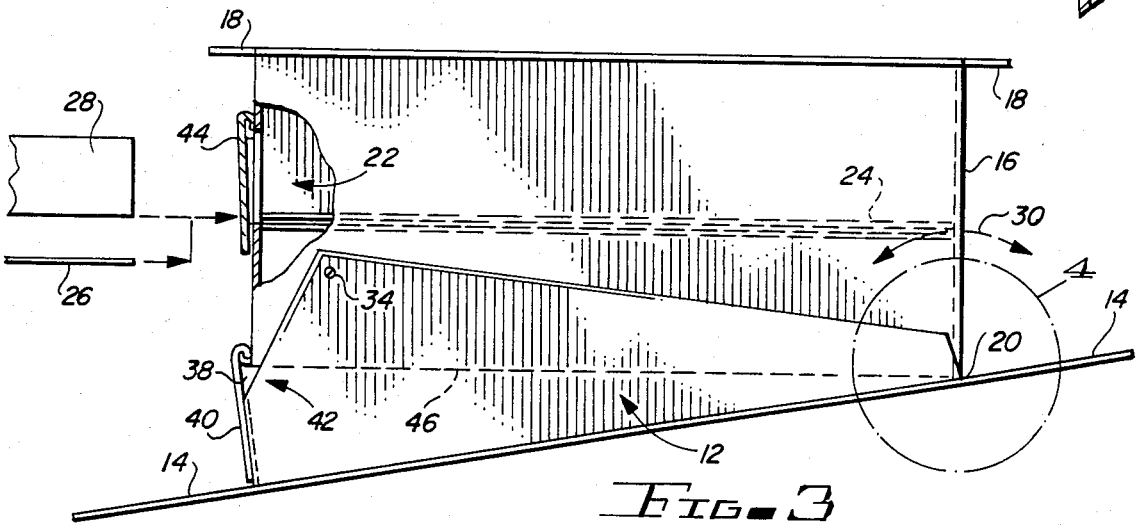
FIG. 3 is a side view of the invention of FIG. 1.

FIG. 3 illustrates "U" shaped tracks pair 24 which accommodate slide 26 via access hole 22. Tracks 24 may also be used to support self contained barometrically operated damper 28 which opens automatically when air pressure (indicating an operating air handler) is sensed. As may be seen from FIG. 3, plate 44 may be used to cover access hole 22 after either slide 26 or barometric baffle 28 are installed or removed therefrom.

FIG. 3 also illustrates the adjustable feature of roof jack 10 of the invention. Double ended arrow 30 indicates that the angle between upper section 16 and lower section 12 of roof jack 10 may be changed and adjusted at the installation site to adapt the angle of roof jack 10 to the installation site roof angle. Break line 20 acts as the hinge between the upper and lower sections of roof jack 10. Once the adjustment is accomplished, self drilling sheet metal screws 32 (one shown) may be installed to lock the two sections 12, 16 with respect to each other and therefor to fix that angle to accommodate the roof angle as required. The design as shown may be adjusted to fit an air handler to any roof angle lying in the range of from zero slope to approximately a 5/12 slope.

While the maximum slope is limited to approximately 5/12 within the design limits of the preferred embodiment of the invention, it will be obvious to one of ordinary skill in the art that other configurations may be employed which would extend the range beyond that limit. If the lower side walls 46 of upper section 16 were to be made greater in depth, it would not be possible to fit roof jack 10 to a flat or zero slope roof. However, it could then be extended to fit slopes greater than 5/12. Additionally, if there were adequate space within the duct emerging from the roof (not shown) so that such extension in depth of the side walls could fit within the roof duct when the assembly of the invention is fully closed (minimum roof angle) it might then be possible to fit a zero or flat slope roof, even with such upper section 16 side wall extended dimensions.

Approximate dimensions for key portions of the preferred embodiment of the invention, as shown in the drawings, are as follows:

Width of lower flange 14=4 inches.

Minimum height of lower section 12=$2\frac{1}{2}$ inches.

Maximum height of bottom section 12 (near hole 34)=$8\frac{3}{4}$ inches.

Height of lower section 12 (at front below opening 42)=$3\frac{1}{2}$ inches.

Width (perpendicular to hinge line 18) of bottom opening=20 inches.

Figure 2:
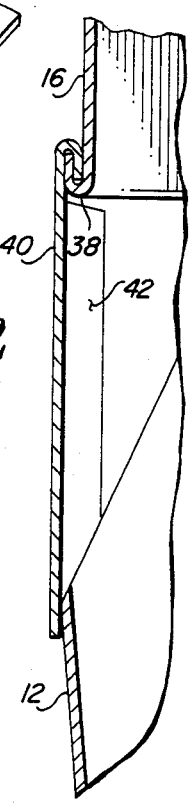
FIG. 2 is a detailed cross section of the invention of FIG. 1.
Figure 4:
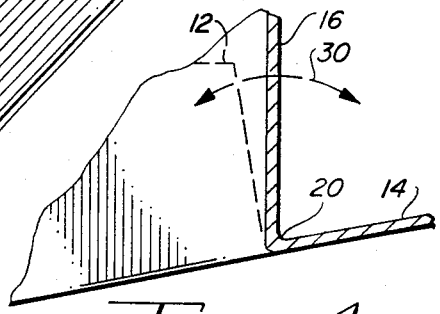
FIG. 4 is an enlarged, more detailed view of the hinge of the invention as shown in FIG. 3.

FIG. 2 is a cross section taken of FIGS. 1 and 3 which shows how plate 40 is used to close gap 42 at the front of the assembly of roof jack 10 when roof jack 10 is adjusted to the high end of the range of roof slopes over which it is effective. Plate 40 has a lip which engages lip 38 of the upper section 16 and supports plate 40 in place over opening 42.

It will be understood by one of ordinary skill in sheet metal work that after the angle of the roof jack of the invention has been adjusted to the roof upon which it is installed and screws 32 have been installed to lock that position, it is necessary to seal the various joints of the roof jack with a suitable roofing sealant. Plate 44 may be sealed in place by using duct tape if it is required to remove and replace it seasonally. Plate 40 may be permanently sealed in place once the angle of the roof jack is set.

It will be readily understood by those of ordinary skill in the sheet metal design and fabrication art that the detailed design and fabrication of the invention, assembly methods and patterns are well known and need not be described herein since they are well within the capabilities of one of ordinary skill in the art. The specific design utilized to fabricate the invention will depend upon the metal working tools available to the artisan and customary practices within his/her particular fabrication organization. While the preferred embodiment of the invention, as described herein, was fabricated from 26 gauge sheet metal, other applications may require another thickness of metal.

While the invention has been particularly shown and described with reference to preferred and other embodiments thereof, it will be understood by those skilled in the art that various modifications and changes may be made to the instant invention utilizing the principles of the invention as described herein without departing from the spirit and scope thereof as encompassed in the accompanying claims. For example, the preferred embodiment of the invention is described as though manufactured from sheet metal. It is anticipated that other materials such as fiberglass or certain sheet plastics may be useful for such fabrication. Therefore, it is intended in the accompanying claims to cover all such equivalent variations as come within the scope of the invention as described.

What is claimed is:

1. A slope adjustable roof jack for connecting a roof mounted air handler to a duct which emerges from and through the roof, the roof having a slope lying within a predetermined range of slopes, the roof jack comprising:

a first rectangular ductlike assembly for attachment at a lower end thereof to the roof and to the emerging duct;

a second rectanglular ductlike assembly for attachment at an upper end thereof to an output of the air handler;

bendable means for providing a weatherproof hinged connection between one side of said first assembly and the corresponding side of said second assembly and for adjusting an angular relationship between said first assembly and said second assembly, said angular relationship being a function of the slope of the roof; and a single continuous sheet of material comprises said one side of said first assembly, said corresponding side of said second assembly and said bendable means.

2. The adjustable roof jack according to claim 1 wherein said bendable means comprises sheet metal.

3. The adjustable roof jack according to claim 1 wherein said single continuous sheet of material is one piece of sheet metal.

* * * * *